US007123823B2

(12) United States Patent
Ceva

(10) Patent No.: US 7,123,823 B2
(45) Date of Patent: Oct. 17, 2006

(54) PROGRAMMABLE MANUAL HAIR DRYER WITH MULTIPLE FUNCTIONS

(75) Inventor: Carlos José Ceva, San Isidro (AR)

(73) Assignee: Duna Enterprises S.A., (PA)

( * ) Notice: Subject to any disclaimer, the term of this patent is extended or adjusted under 35 U.S.C. 154(b) by 0 days.

(21) Appl. No.: 11/081,148

(22) Filed: Mar. 15, 2005

(65) Prior Publication Data

US 2006/0098962 A1 May 11, 2006

(30) Foreign Application Priority Data

Nov. 5, 2004 (AR) ..... 20040104095

(51) Int. Cl.
*A45D 20/10* (2006.01)

(52) U.S. Cl. ..... 392/385; 392/380; 392/383

(58) Field of Classification Search ..... None
See application file for complete search history.

(56) References Cited

U.S. PATENT DOCUMENTS

| | | | | |
|---|---|---|---|---|
| 5,805,406 | A * | 9/1998 | Mailand | 361/212 |
| 6,191,930 | B1 * | 2/2001 | Ramchandani | 361/213 |
| 6,393,718 | B1 * | 5/2002 | Harris et al. | 34/96 |
| 6,640,049 | B1 * | 10/2003 | Lee et al. | 392/385 |
| 6,941,675 | B1 * | 9/2005 | Slingo | 34/96 |

* cited by examiner

*Primary Examiner*—Thor S. Campbell
(74) *Attorney, Agent, or Firm*—Hughes Hubbard & Reed LLP; Ronald Abramson; Peter A. Sullivan

(57) ABSTRACT

The dryer includes in its programmable control circuit a microprocessor to which are connected at least a temperature sensor, a static pressure sensor, a motor revolution sensor, a ion generator, a resistor battery with its selector switches in series, and the respective power circuits of the motor and the air heater aforesaid, in which, in order to optimize the processing route, said microprocessor, after the dryer is turned on and the operating values of parameters, establishes the initial operating configuration at 50% of the value thereof, and then defines continuously, in terms of the ordinary data base, the constant functional conditions, and responds to electric, thermal and mechanical discrepancies being involved with its corrective stabilization, recording, signaling and information by means of a display. The stabilization of the ordinary operation conditions, both of the motor and of the heating resistor is achieved by means of the corresponding sensor, the information from which is channeled towards and from the respective speed and temperature control while the signaling and the information are carried out by connecting the respective control in turn to the corresponding VU meter and the equipment display. The recording of events receives directly the information from sensors and from speed and temperature controls, while from the aforesaid speed and temperature controls the information is sent back to the parameter status verification point.

10 Claims, 4 Drawing Sheets

PROGRAMMABLE MANUAL HAIR DRYER WITH MULTIPLE FUNCTIONS

This application claims benefit of Argentinean Application No. 20040104095, filed on Nov. 5, 2004, which is hereby incorporated by reference.

BACKGROUND OF THE INVENTION

1. Field of the Invention

This invention concerns elements of domestic use in general, more particularly, manual hair dryers, referring specifically to an intelligent dyer.

2. Description of Prior Art

In the prior art are used the so-called manual hair dryers, of which certain construction and design varieties are known. Most of hair dryers are designed to satisfy certain purposes as regards the way of distributing and utilizing the flow of air at the outflow. Thus, different forms of interchangeable nozzles are found, which are attached to the air outlet pipe by means of which the air blast can be concentrated or diffused to improve the result desired. These attachable elements can be supplemented by various combs or brushes which satisfy the creations of the stylist who uses it.

As regards the functional alternatives of this kind of dryers, they are generally limited to an additional on or off switch of the air heating unit and the selection of a maximum or minimum airflow acting on the motor speed.

Other special requirements to be controlled are built into the large commercial hair dryers.

Each of these elements has special characteristics to achieve the aim, among them that the programmable control circuit includes a microprocessor to which are connected at least a temperature sensor, a static pressure sensor, a motor revolution sensor, a ion generator, a resistor battery with its selector switches in series, and the respective power circuits of the motor, and the air heating device above mentioned, in which, in order to optimize the processing route, said microprocessor, once the dryer is turned on, and the operating values of its parameters selected, establishes the initial operating configuration at 50% of the value thereof and then defines on a continuous basis, in terms of the ordinary data base, the constant functional conditions and responds to electric, thermal, and mechanical discrepancies with its corrective stabilization, recording, signaling and information by means of a display.

BRIEF SUMMARY OF THE INVENTION

The main object of the invention is aimed at getting a very simple and economic arrangement applied to manual hair dryers, having the capacity of recording and communicating a certain number of operating and functional parameters of interest for the user, therefore being programmable and having multiple functions.

An additional purpose of this invention is to provide an arrangement conceived for the object proposed, applied in this particular case to manual hair dryers, which comprises an electronic circuit that gives it several operating capacities making it possible to change the operating conditions and cycles of the device, storing and displaying at the same time certain information about the control of certain factors which govern its operating capacity, such as the flow of air expelled, the temperature value, its cold-hot alternation, and others which will be explained in these Specifications. For the purposes briefly stated, the dryer comprises a circuit including a microprocessor governed by software to receive the information from a group of temperature, pressure sensors, and the control of the motor revolutions and the values selected by the user. On the other hand, the memory also keeps a record of the parameters selected and measured by the circuit, as well as the unit operating time. It also checks that the values selected are compatible with the capacity of the electric components of the circuit.

To achieve successfully all these functions, the microprocessor is programmed to check continuously the motor speed, not only to be able to adjust the control variables, but also to handle the acceleration ramps. Another important parameter is the current circulating through the heating resistor, whose value will be regulated for the purpose of controlling the expelled air temperature. It operates all the lighting controls which show its operation through a program level indicator, in addition to the display on which all the set instantaneous values are shown. From where the factors to be measured will be: air flow circulating in the device, output temperature, the rpm of the motor, hours of use and the consumption current and tension, both of the motor and of the heating resistor.

All the measured variables make up the input and output of the closed loop control device, which makes it possible to select a temperature and flow rate with total independence of the external conditions. This device control will adjust the variables so that the temperature flow rate requirements mentioned match at all times those which have been previously selected.

Therefore, the flow chart is hereto attached by which the microprocessor is governed and adjusted.

From the observation thereof there appears that the control shown by the diagram stands out as a major factor ensuring a safe and constant operation of the dryer. As all the functional parameters are constantly controlled, and as the maximum values consistent with the electromechanical characteristics of the equipment have been a priori set in the factory, the dryer is auto-protected with respect to the inadequate or too intense use which may damage it. The important values have to do with dissipated power and the revolutions of the motor, whose maximum values have been set forth in the information, so that they won't be exceeded at any time.

The program keeps a permanent record of the operation of the device, which accumulates all those values, adding up the hours of work, including the date on which it is first used, which establishes the precise date for the warranty and the conditions under which it is done, all of which makes it possible to announce the preventive maintenance tasks required by the equipment.

In order to make comprehensible this invention which consists of a programmable manual hair dryer with multiple functions, so that it can be put into practice easily, a precise description of a preferred form of embodiment will be provided in the following paragraphs, making reference therein to the drawings attached, only for illustration and demonstration purposes, but not restricting the invention, the components of which can be selected among different equivalents without deviating because of that from the principles of the invention established in the present documentation.

BRIEF DESCRIPTION OF THE SEVERAL VIEWS OF THE DRAWINGS

In the schematic drawings which accompany this technical & legal description.

In the diagrams of FIGS. 4, 5 and 6 the solid line curves correspond to the flow rate values. In the above descriptive figures the same reference characters indicate equal or corresponding parts.

DETAILED DESCRIPTION OF THE INVENTION

Figure 1:
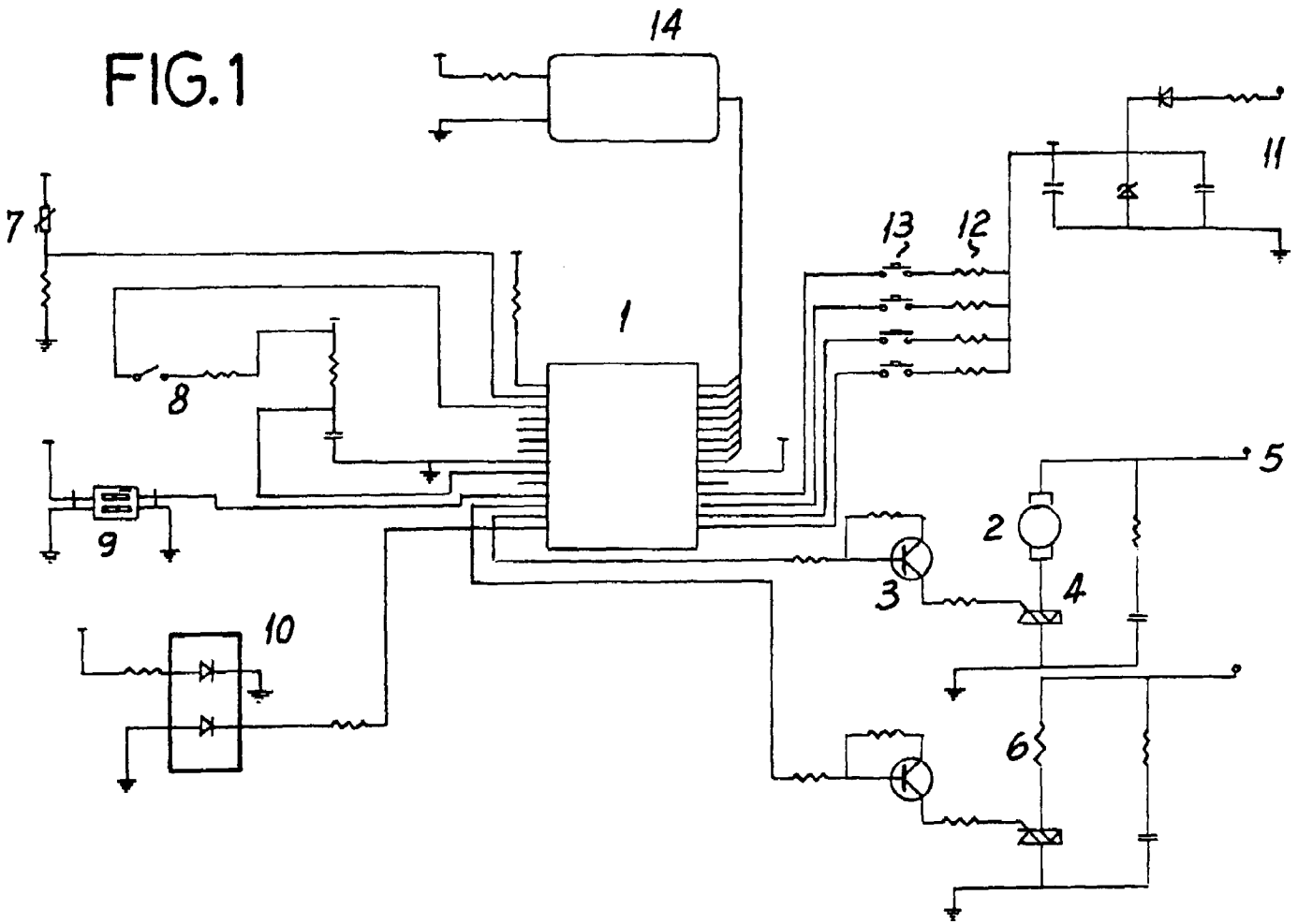
FIG. 1 represents a preferred circuit applied in tire invention.

According to FIG. 1, the circuit taken as an example of the invention embodiment is made up of an integrated circuit 1 of the "Peripheral Interface Controller 16F873" type, or a similar one, connected to the electric motor 2 which drives the dryer through a transistor 3 whose collector is connected in series to the triac 4 in which the motor-triac series (sic) receives the current supply 5 including the elements conventional capacitor and resistor.

Likewise, with another similar circuit, the processor is connected to the heating resistor 6.

The circuit shows the connections corresponding to the temperature sensor 7, the filter sensor 8, the pressure sensor 9 and the optocoupler sensor 10 which picks up the revolutions of the motor.

The device which controls the regulation of the corresponding parameters which enables the electric diagram can be made up of the current supply 11 which includes the necessary components such as a rectifying diode, a zener diode and an electrolytic filter, to which the relevant circuit components are added, such as a limiting resistor and a capacitor, the whole of which feeds a resistor battery 12 in series with its selector switches 13.

The operating verification can be made by means of a liquid crystal display 14, provided also with the indications given by the speed and temperature VU meters.

Figure 2:
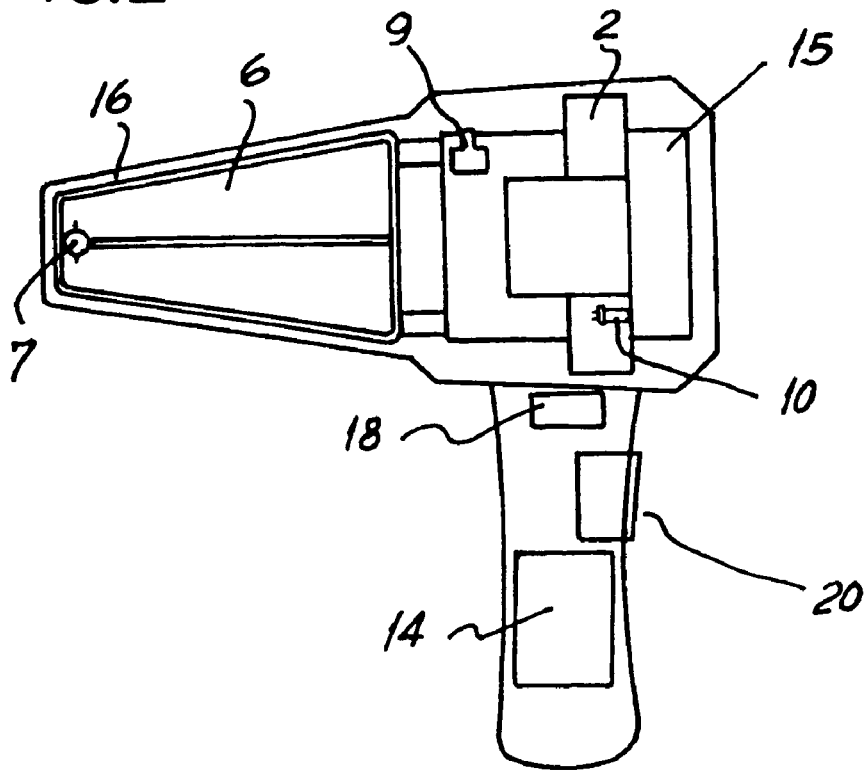
FIG. 2 consists of a dryer having the arrangement described.

FIG. 2 shows a possible way of placing the components of the invention within the housing of a manual hair dryer. Each basic component has been represented in the same schematic way, the motor 2 and the detector of its number of revolutions, with its optocoupler 10. EL motor drives a turbine 15 which projects air through the front nozzle 16 where the heating resistor 6, with the corresponding heat-detecting thermocouple 7 and the filter 17 with its pressure sensor 9. Included there is also the plate with the electronic components of the circuit.

In the handle of the housing is placed the ion generating device 18 with its corresponding emitter electrode 19 located within the nozzle 16. Also installed in the handle are the following elements: the keyboard 10, temperature range, speed and ion-generator coming-into-operation selectors, providing the push buttons corresponding to switches 13.

In the handle is the display 14, which indicates the functions and values of the parameters that take part in the functioning of the device, the data recorded in the memory, and the menu that provides them.

It should be made clear that as very low tension values are handled, for the operating control of the dryer through the microprocessor 1, there does not exist any electric inconvenience or danger to locate the switches 13 in the handle within the user's reach.

Figure 3:
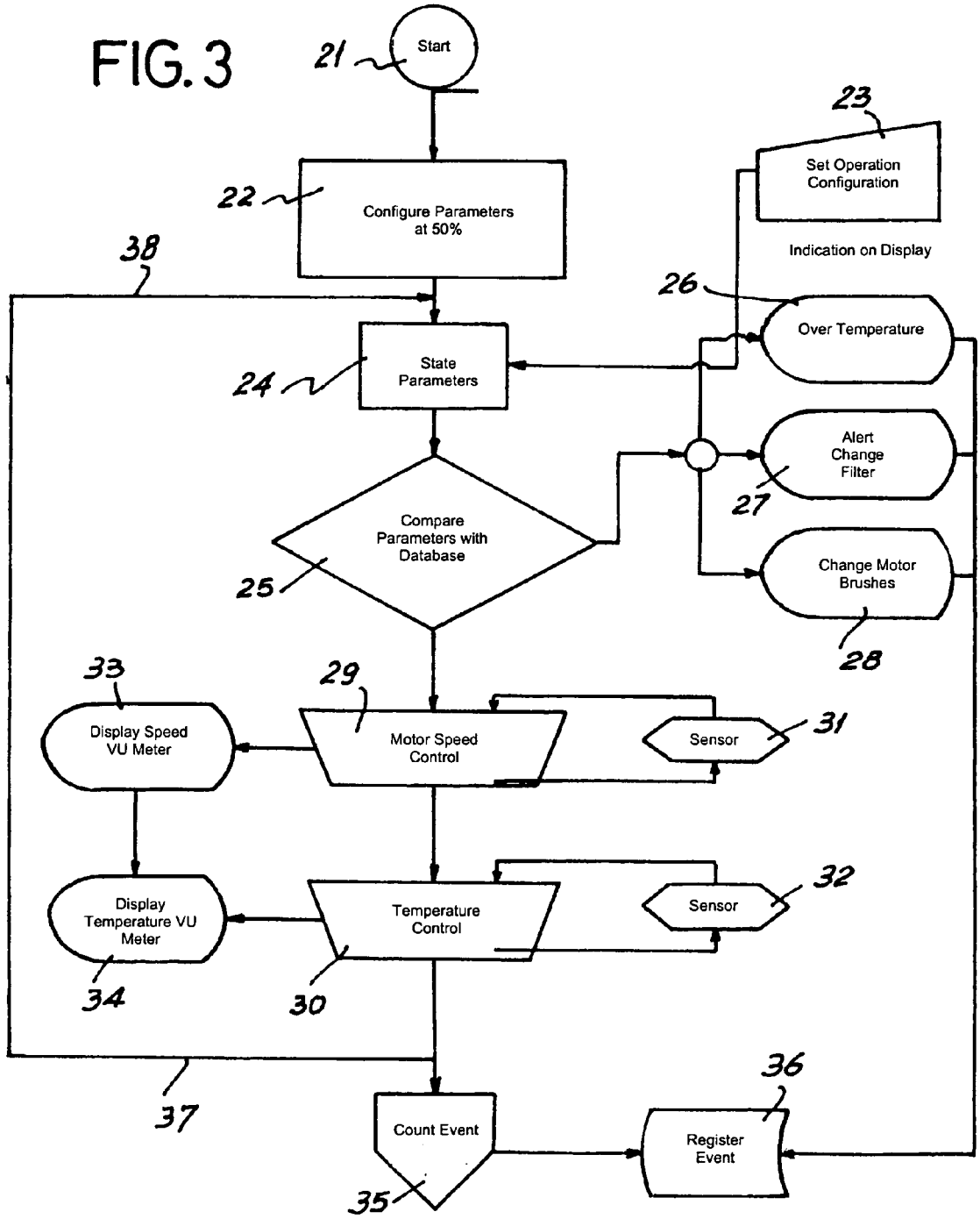
FIG. 3 shows the flowchart that governs the operation of the microprocessor.

In FIG. 3 is represented the flow chart, with the starting (turning on) or beginning 21 that establishes the configuration 22 of the initial functions, adjusting parameters at 50% of their value. Once the operating parameters 23 are determined, the input with the operation configuration 23 is set, the status of parameters being established 24. Functional operations shall be indicated on the display 14.

The operation is governed by comparing the parameters with the data base indicated in 25 from where are established the limitations distributed from—A—to possible over-temperature values 26, detected by the thermocouple 7, the alarm of problems with the filter, either for the change of filter 27, determined by the electronic pressure sensor 9 or by the sensor which indicates the tack of filter 8. Problems in the motor are indicated by the replacement of the motor brushes 28, which will result from the verification in the data base with the ordinary operating values and the accumulated operation time.

The same happens with the motor speed control in 29 and the temperature control in 30, in reply to the sensor records 31 and 32 provided by the respective elements 10 and 7.

In these controls is also involved the displaying, as defined in the instructions 33 and 34 channeled to the display 14 and speed and temperature VU meters.

From the initial state and following the chain of events determined in the diagram, they are finally defined by the event counter 35 and its records 36, which compile the most important data about the operation, maintenance and control of the dryer.

The diagram shows the relationship existing at the output of controls 29 and 30 aforesaid, designated with the number 37 with the incoming information at 38 to (sic) the status of parameters 24.

Operation

Once established the different components of the invention version, developed to explain its nature, the description is immediately supplemented by the functional and operating relationship of its parts and the result they provide.

FIGS. 1 and 2 show a circuit and a device made up of the several components that make it possible to put into practice the proposals of the invention, in one of its possible embodiments, the flowchart of FIG. 3 following the instructions detailed in the program also developed as a preferred form.

Figure 4:
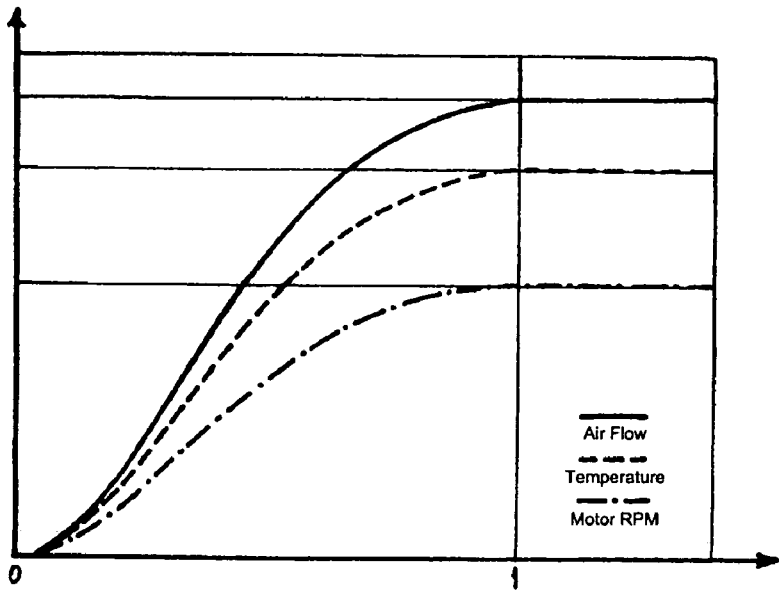
FIG. 4 illustrates a dryer power-up diagram in terms of time, with the flow, temperature and motor revolution curves.
Figure 5:
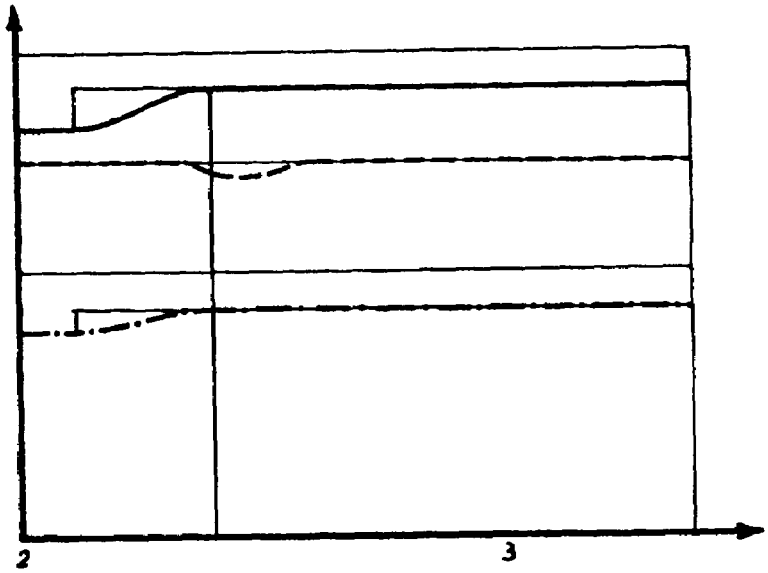
FIG. 5 represents the diagram for the change of the flow rate operating point in terms of time.

The drawings of FIGS. 4 and 5 describe a way of operation of the dryer, in terms of time, in different possible events.

When the dryer is first used, it's set at the initial "0" point, and without having the filter installed, since it's separately provided, the sensor corresponding to "filter installed" shows such an anomaly on the display, indicating the lack of filter, hindering at the same time the motor starting. The sensor will react in the same way, if the filter were wrongly installed, disabling the operation of the device, although the on switch (button) is pressed several times.

The first time the filter is installed, detected by the sensor, it sends a signal to the microprocessor which starts the recording, stating the date and the hours of use beginning at "0"; this data is stored in the memory, the turning on of the dryer thus being enabled.

When the dryer is turned on, there occurs an acceleration ramp of the motor, and the progressive mild heating of the heater until reaching the values registered at the values initially determined in the factory. The slow pre-established heating has the purpose of increasing the useful life of the components of the device.

Once the dryer operation reaches the "SET POINT" of temperature and air flow selected, curves reach point 1 of the Cartesian diagram of FIG. 4 and get stabilized, remaining constant throughout use. The dotted lines indicate the operation values selected at axis X. In conventional dryers only the positions indicated in the controls are defined, but there is no information about the possible variations that may arise during their use. Instead, it is known that a change in the external conditions for this known type of dryers will result in a change in flow rate and temperature, a problem which does not happen with the dryer of this invention.

If any change in the desired flow were made, going to point 2 of FIG. 5, without having changed the temperature level, its value should not change, so that the motor revolutions will increase in order to satisfy the greater demand for flow which, as it increases, will reduce—a—the temperature at the dryer outlet. The corresponding sensor will detect it and the microprocessor will order an increase of current in the resistor to compensate for the decrease in temperature, increasing it to the determined value, and then returning to the value previously determined. These alterations have been reflected in the corresponding curves.

It can be pointed out that in a conventional dryer, these corrections cannot be made through its open loop operating system which does not make it possible to know the real state of flow at the device outlet.

The example of the change in the value of temperature is the most simple, since the microprocessor merely regulates the current circulating in the heating resistor and limits the maximum value to protect the circuit. If the user wishes to set a temperature value above the limit, he cannot do so, and the display will show the reason why he cannot do so, as the temperature is very high for the current flow rate selected.

Figure 6:
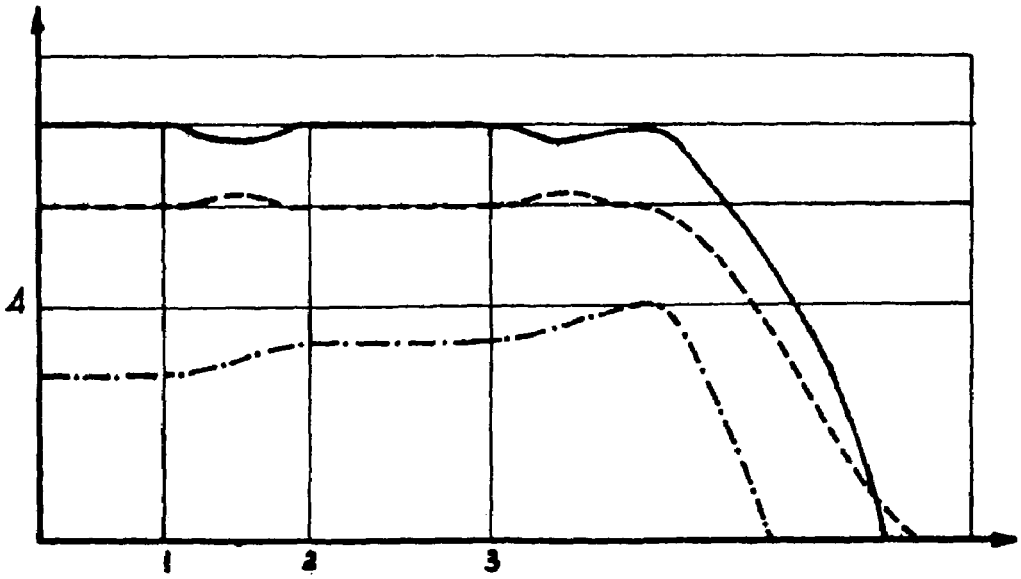
FIG. 6 consists of a filter obstruction graph.

Let's suppose the case in which no variable changes, but the change originates in the external conditions, for example, a partial obstruction of the filter, see FIG. 6. This situation would cause a decrease in the flow rate and, therefore, an increase in temperature. In order to compensate for the variation, the microprocessor will send an order to the motor so that it turns at a higher speed to restore the original flow rate. Once the flow rate is balanced, the temperature will also be stabilized without any further adjustment.

Continuing with the same graph, a greater obstruction of the filter can be imagined. In the diagram is indicated the variation of corresponding curves, where the first obstruction is between points 1 and 2 indicated at the corresponding axis, while the second obstruction begins at point 3. Corrections will follow the same reasoning above, but when its value gets point 4, in which the relationship flow rate-motor r.p.m. reaches such an extent in which the motor is overdriven, the current supply is interrupted at that time, and the operation of the dryer is completely stopped. At the same time, the display will show "Change filter". The dryer will then be disabled for use and will be enabled when the filter is changed. The situation will be detected by the filter sensor. That is to say, enablement requires the replacement of the filter. All that process will be recorded and stored in the computer memory, as well as all the filter replacements made during the life of the device.

It is evident then, that what is shown in the charts analyzed will be stored in the memory, as established in the steps indicated by the event counter 35 and the event record 36 in which all the ordinary and possible events to which the dryer will be subject during its operation will be recorded. All the operating history of the equipment will thus be recorded, which will announce not only the maintenance tasks on the display 14 but also everything that might be of interest for the best operation of the equipment, such as the need to replace the filter, the motor bearings, etc.

In brief, the command circuit comprises a microprocessor connected to the electric motor of the dryer through a transistor the collector of which is connected in series to a triac, where the motor-triac series includes the conventional elements capacitor and resistor, and with the same electrical layout (arrangement), the heating resistor is fed; said microprocessor is connected to a temperature sensor, a filter sensor, a pressure sensor and a motor speed sensor; said circuit includes displaying and adjustment and connection elements of the operating parameters of the equipment governed by the microprocessor and adjusted by means of a program.

Thus one of the construction possibilities have been described, which lead to materialize the invention and the way in which it works, its specific application being also comprised, and the documentation being supplemented by the synthesis of the invention contained in the claims which follow.

I claim:

1. Programmable manual hair dryer with multiple functions, the type made up of an electric motor which drives an air expelling turbine through a nozzle by means of a heating resistor, and provided with a cold-hot selector, characterized because in its programmable control circuit includes a microprocessor to which are connected at least a temperature sensor, a static pressure sensor, a motor revolution sensor, a ion generator, a resistor battery with it selector switches in series, and the respective power circuits of the motor and the air heater aforementioned, in which, in order to optimize the processing route, said microprocessor, after the dryer has been turned on and the value of its parameters selected, establishes the initial operating configuration at 50% of the value thereof, and then defines continuously, in terms of the ordinary data base, the constant functional conditions, responding to electrical, thermal and mechanical discrepancies involved in its corrective stabilization, recording, signaling and information by means of a display.

2. Programmable manual hair dryer with multiple functions, according to claim 1, characterized because the command circuit comprises a microprocessor connected to the electric motor which drives the dryer through a transistor the collector of which is connected in series to a triac, where the motor triac series, including the conventional elements, capacitor and resistors, insofar as, with the same electric layout (arrangement), the heating resistor is fed (sic); said microprocessor is connected to a temperature sensor, a filter sensor, a pressure sensor and a motor speed sensor; said circuit includes displaying and adjustment and connections elements of the operating parameters of the equipment governed by the microprocessor adjusted by means of a program.

3. Programmable manual hair dryer with multiple functions, according to claim 2, characterized because said adjustment and connection elements of the operating parameters of the equipment, connected to the current supply and to the microprocessor, include a rectifier diode, a Zener diode and an electrolytic filter to which the due components of the circuit are attached, such as a limiting resistor and a capacitor, the whole of which feeds a resistor battery in series with its selector switches.

4. Programmable manual hair dryer with multiple functions according to claim 2, characterized because said displaying elements connected to the microprocessor consist of a liquid crystal display.

5. Programmable manual hair dryer with multiple functions, according to claim 1, characterized because said microprocessor selected is of the "Peripheral Interface Controller 16F873" type, or similar.

6. Programmable manual hair dryer with multiple functions, according to claim 2, characterized because said electric motor speed sensor is an optocoupled sector, and the temperature sensor is a thermocouple.

7. Programmable manual hair dryer with multiple functions, according to claim 1, characterized because said signaling elements include at least a VU meter.

8. Programmable manual hair dryer with multiple functions, according to claim 1, characterized because said stabilization of the normal operating conditions, both of the motor and of the heating resistor, is made by means of a sensor, the information of which is channeled to and from the respective speed and temperature control insofar as, the signaling and information is carried out by connecting the respective control to the corresponding VU meter and the equipment display.

9. Programmable manual hair dryer with multiple functions, according to claim 1, characterized because said recording produces a record of events receives directly the information from the speed and temperature controls and sensors.

10. Programmable manual hair dryer with multiple functions, according to claim 1, characterized because from said speed and temperature sensors, the information is sent back to the point of verification of the parameter status.

* * * * *